US007299995B2

(12) United States Patent
Watari et al.

(10) Patent No.: US 7,299,995 B2
(45) Date of Patent: Nov. 27, 2007

(54) EXPANSION VALVE

(75) Inventors: Daisuke Watari, Tokyo (JP); Masamichi Yano, Tokyo (JP)

(73) Assignee: FujiKoki, Corporation, Tokyo (JP)

( * ) Notice: Subject to any disclaimer, the term of this patent is extended or adjusted under 35 U.S.C. 154(b) by 572 days.

(21) Appl. No.: 10/797,106

(22) Filed: Mar. 11, 2004

(65) Prior Publication Data

US 2004/0177632 A1 Sep. 16, 2004

(30) Foreign Application Priority Data

Mar. 12, 2003 (JP) ..... 2003-066024
Nov. 6, 2003 (JP) ..... 2003-376955

(51) Int. Cl.
*F25B 41/04* (2006.01)

(52) U.S. Cl. ..... 236/92 B; 236/92 C; 62/222

(58) Field of Classification Search ..... 236/92 B; 62/222

See application file for complete search history.

(56) References Cited

U.S. PATENT DOCUMENTS

| | | | | |
|---|---|---|---|---|
| 4,542,852 | A | 9/1985 | Orth et al. | |
| 6,029,694 | A | 2/2000 | Schwegler et al. | |
| 6,702,188 | B2 * | 3/2004 | Yano et al. | 236/92 B |
| 2002/0100812 | A1 * | 8/2002 | Sudo et al. | 236/92 B |
| 2002/0185621 | A1 * | 12/2002 | Kobayashi et al. | 251/61.3 |

FOREIGN PATENT DOCUMENTS

| | | |
|---|---|---|
| CN | 1397778 A | 2/2003 |
| EP | 1 275 916 A2 | 1/2003 |
| JP | 08-145505 | 6/1996 |
| JP | 09-222268 | 8/1997 |
| JP | 2001-50422 | 2/2001 |
| JP | 2001-50617 A1 | 2/2001 |

OTHER PUBLICATIONS

European Search Report, Application No./Patent No. 04005534.5-2301, dated Feb. 3, 2006.

* cited by examiner

*Primary Examiner*—Cheryl J. Tyler
*Assistant Examiner*—Gene Bankhead
(74) *Attorney, Agent, or Firm*—Rader, Fishman & Grauer PLLC

(57) ABSTRACT

The body of a valve has an orifice that internally connects a high-pressure passage through which a refrigerant flows in and a low-pressure passage through which the refrigerant flows out. The valve includes a valve plug for adjusting the flow rate of the refrigerant flowing in the orifice, an operating rod for moving the valve plug in a valve opening direction, and a temperature sensing drive unit for driving the operating rod. A support ring for constraining the spherical valve plug is located on the upper-stream side of the high-pressure passage with respect to the orifice. The support ring is formed of a circular annular portion capable of elastic deformation and vibration-proof springs. The springs support the valve plug.

22 Claims, 13 Drawing Sheets

EXPANSION VALVE

BACKGROUND OF THE INVENTION

1. Field of the Invention

The present invention relates to an expansion valve constituting a refrigerating cycle.

2. Description of the Related Art

There are expansion valves of various types. In widely used expansion valves, a valve plug is opposed downstream to an orifice that is formed by constricting the middle of a high-pressure refrigerant passage through which a high-pressure refrigerant to be fed into an evaporator passes. The valve plug is opened and closed in accordance with the temperature and pressure of a low-pressure refrigerant that is delivered from the evaporator.

Such an expansion valve is used in a refrigerating cycle 1, e.g., a vehicular air conditioning system shown in FIG. 21. The refrigerating cycle 1 comprises a refrigerant compressor 2 that is driven by means of an engine, a condenser 3 connected to the discharge side of the compressor 2, and a liquid reservoir 4 connected to the condenser 3. The cycle 1 further comprises an expansion valve 5, which adiabatically expands a liquid refrigerant from the reservoir 4 into a gas-liquid refrigerant, and an evaporator 6 connected to the valve 5. The expansion valve 5 is situated in the refrigerating cycle 1.

The expansion valve 5 is provided with a high-pressure passage 5*b*, through which the liquid refrigerant flows into a valve body 5*a*, and a low-pressure passage 5*c* through which the adiabatically expanded gas-liquid refrigerant flows out. The passages 5*b* and 5*c* communicate with each other by means of an orifice 7. A valve chest 8*d* of the valve 5 is provided with a valve plug 8, which adjusts the volume of passage of the refrigerant through the orifice 7.

Further, a low-pressure refrigerant passage 5*d* penetrates the valve body 5*a* of the expansion valve 5. A plunger 9*a* is disposed for sliding motion in the refrigerant passage 5*d*. The plunger 9*a* is driven by means of a temperature sensing drive unit 9, which is fixed to the upper part of the valve body 5*a*. The interior of the drive unit 9 is divided into two parts, an upper airtight chamber 9*c* and a lower airtight chamber 9*c*', by a diaphragm 9*d*. A disc portion 9*e* on the upper end of the plunger 9*a* is in contact with the diaphragm 9*d*.

At the bottom of the valve body 5*a*, moreover, a compression coil spring 8*a* that urges a support member 8*c* to press the valve plug 8 in the valve closing direction is located in the valve chest 8*d*. The valve chest 8*d* is defined by an adjusting screw 8*b* that mates with the valve body 5*a*, and is kept airtight by means of an O-ring 8*e*. An operating rod 9*b*, which moves the valve plug 8 in the valve opening direction as the plunger 9*a* slides, abuts against the lower end of the plunger 9*a*.

The plunger 9*a* in the temperature sensing drive unit 9 transmits the temperature in the low-pressure refrigerant passage 5*d* to the upper airtight chamber 9*c*. The pressure in the chamber 9*c* changes depending on the transmitted temperature. If the temperature is high, for example, the pressure in the upper airtight chamber 9*c* rises, and the diaphragm 9*d* depresses the plunger 9*a*. Thereupon, the valve plug 8 moves in the valve opening direction, so that the volume of passage of the refrigerant through the orifice 7 increases, and the temperature of the evaporator 6 is lowered.

If the temperature in the low-pressure refrigerant passage 5*d* is low, on the other hand, the pressure in the upper airtight chamber 9*c* lowers, so that the force of the diaphragm 9*d* to depress the disc portion 9*e* lessens. Thereupon, the compression coil spring 8*a*, which presses the valve plug 8 in the valve closing direction, urges the valve plug 8 to move in the valve closing direction. Thus, the volume of passage of the refrigerant through the orifice 7 is reduced, and the temperature of the evaporator 6 is raised.

Thus, in the expansion valve 5, the valve plug 8 is moved to change the opening area of the orifice 7 in response to a change of temperature in the low-pressure refrigerant passage 5*d*. By doing this, the volume of passage of the refrigerant is regulated to adjust the temperature of the evaporator 6. According to the expansion valve 5 of this type, the opening area of the orifice 7 that adiabatically expands the liquid refrigerant into the gas-liquid refrigerant is set by adjusting the spring load of the variable-load compression coil spring 8*a*, which presses the valve plug 8 in the valve closing direction, by means of the adjusting screw 8*b*.

In some cases, however, the high-pressure refrigerant that is fed into the expansion valve may undergo fluctuation in pressure on the upper-stream side in the refrigerating cycle. This pressure fluctuation is transmitted to the expansion valve through the medium of the high-pressure refrigerant.

If the refrigerant pressure on the upper-stream side is transmitted to the valve plug by the pressure fluctuation in the conventional expansion valve constructed in this manner, the action of the valve plug may possibly be destabilized. In this case, the expansion valve may fail to enjoy accurate flow control, or noise may be produced owing to vibration of the valve plug.

According to conventional means to solve this problem (see Jpn. Pat. Appln. KOKAI Publication No. 2001-50617), a spring or the like is used to apply an urging force laterally to an axially movable rod that is located between a power element and a valve plug, thereby preventing the valve plug from becoming susceptible to the pressure fluctuation of the high-pressure refrigerant so that its action is stable.

SUMMARY OF THE INVENTION

Although the conventional expansion valve described above can achieve an object to stabilize the action against the pressure fluctuation of the high-pressure refrigerant, however, the spring that laterally presses the axially moving rod must be located in a stable state. Thus, the valve requires complicated construction and elaborate assembly operation, possibly entailing high cost.

The object of the present invention is to provide an expansion valve capable of ensuring stable action against fluctuation of the pressure of a high-pressure refrigerant with the use of simple, low-cost means.

In order to solve the aforementioned problems, according to a first aspect of the invention, there is provided an expansion valve in which a valve plug is driven by means of a temperature sensing unit which operates in accordance with the temperature and pressure of a low-pressure refrigerant delivered from an evaporator and adjusts the flow rate of refrigerant flowing into the evaporator. The expansion valve comprises constraint means for applying a force of constraint to the valve plug or an operating rod for opening and closing the valve plug, the constraint means being attached to the valve plug or the operating rod.

According to a second aspect of the invention, there is provided an expansion valve, which comprises a valve body having an orifice internally connecting a high-pressure passage through which a refrigerant flows in and a low-pressure passage through which the refrigerant flows out, a valve plug for adjusting the flow rate of the refrigerant flowing in the orifice, an operating rod for opening and closing the valve plug, a temperature sensing drive unit for driving the operating rod, and constraint means for constraining the valve plug or the operating rod, the constraint means being located on the upper-stream side of the high-pressure passage with respect to the orifice.

Each of the expansion valves according to the first and second aspects may assume the following aspects.

The constraint means may be attached to the valve body.

The constraint means may apply a force of constraint to the valve plug or the operating rod by means of elasticity.

The valve plug may be spherical, and the constraint means is a support ring supporting the valve plug or the operating rod.

The support ring may be formed of a circular annular portion capable of elastic deformation and vibration-proof springs, the springs supporting the valve plug or the operating rod.

The support ring may be formed of upper and lower circular annular portions and vibration-proof plate springs cut out of the annular portions.

The support ring may be formed of a circular annular portion and vibration-proof plate springs arranged on one side of the annular portion.

Each of the vibration-proof springs may be formed of a curved plate and may support the valve plug or the operating rod on a side face thereof.

Each of the vibration-proof springs may be formed having a portion to be in pointed contact with the operating rod. The portion to be in pointed contact with the operating rod may be hemispherical, may have a cylindrical outer peripheral surface, or may be in the form of a ridge.

As is evident from the above description, the valve plug of the expansion valves of the present invention, constructed in this manner, can be restrained from vibrating as the refrigerant pressure fluctuates. Further, the constraint means according to the invention has so simple a construction that it can be easily worked and attached to the valve plug. Thus, the expansion valves are easy to handle and highly available. Since the vibration-proof springs of the support ring are brought into pointed contact with the operating rod to support it, moreover, the operating rod can be smoothly supported if it is somewhat inclined.

BRIEF DESCRIPTION OF THE DRAWINGS

The above and other objects and features of the invention will be more apparent from the ensuing description of embodiments taken in connection with the accompanying drawings, in which.

DESCRIPTION OF THE EMBODIMENTS

Embodiments of the present invention will now be described with reference to the accompanying drawings.

Embodiment 1

Figure 1:
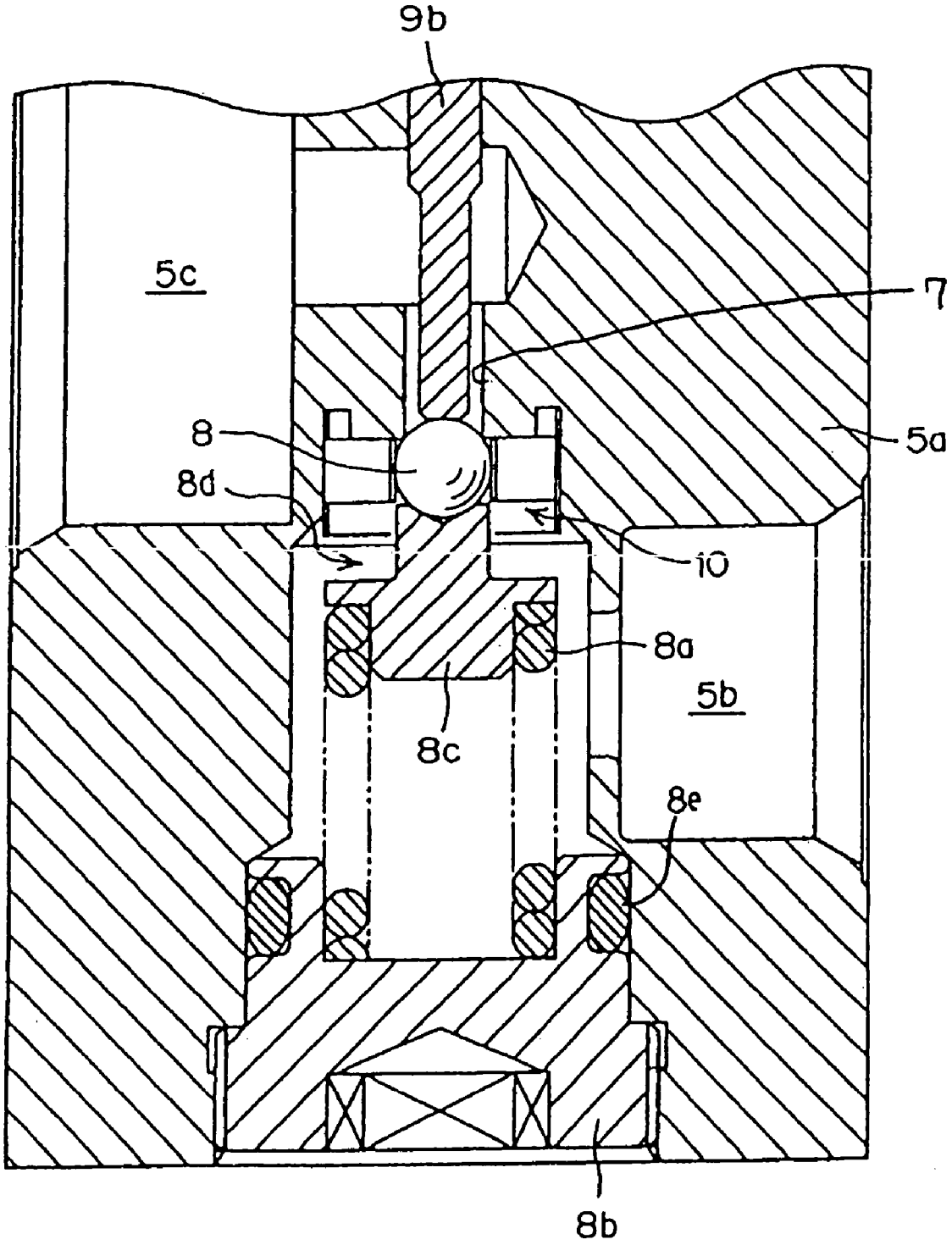
FIG. 1 is a sectional view showing a principal part of an expansion valve according to Embodiment 1 of the invention.
Figure 2:
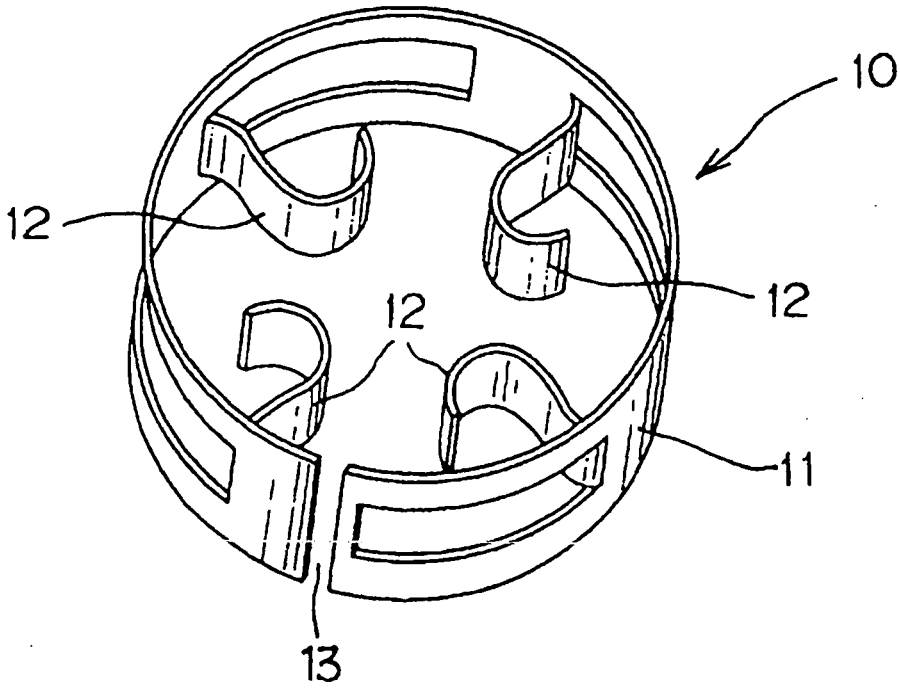
FIG. 2 is a perspective view of a support ring of the expansion valve of FIG. 1.
Figure 3:
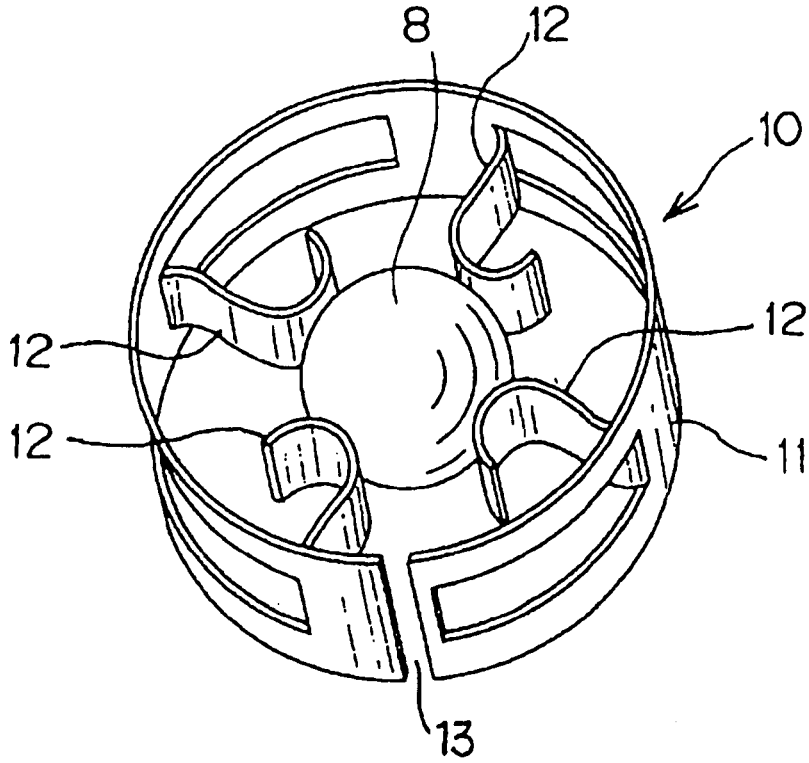
FIG. 3 is a perspective view showing the way the support ring of FIG. 2 supports a valve plug.
Figure 4:
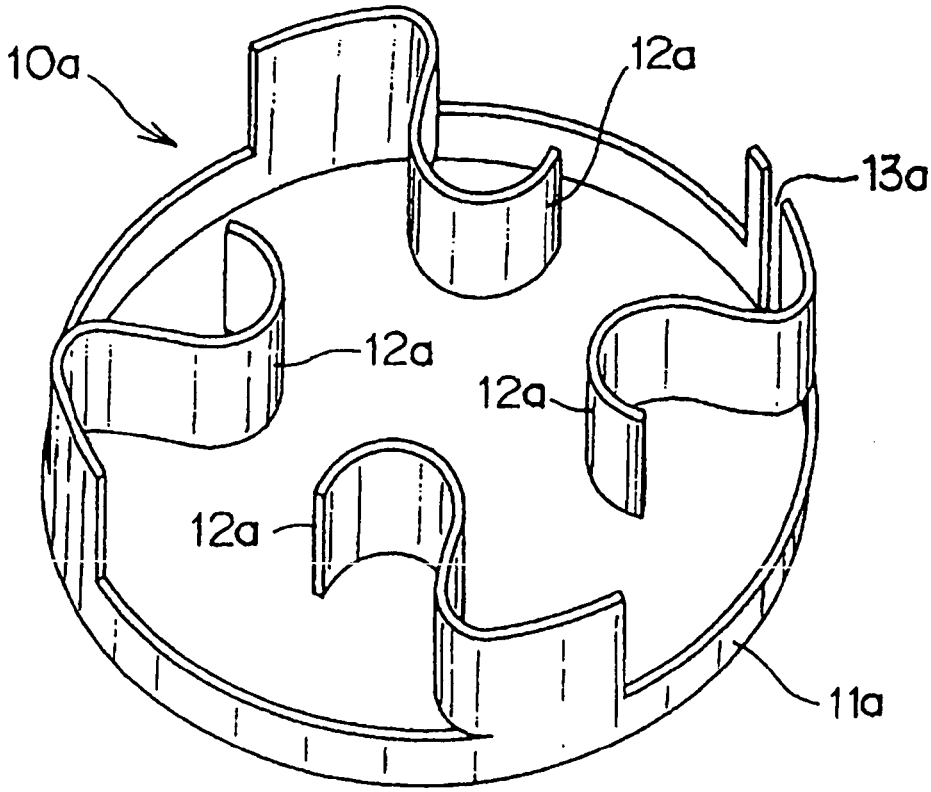
FIG. 4 is a perspective view of a support ring used in an expansion valve according to Embodiment 2 of the invention.

Embodiment 1 of the present invention will be described first. FIG. 1 is a sectional view showing a principal part of an expansion valve according to Embodiment 1. FIG. 2 is a perspective view of a support ring of the expansion valve. FIG. 3 is a perspective view showing the way the support ring supports a valve plug. FIG. 4 is a perspective view of another example of the support ring. In FIG. 1, like numerals are used to designate like portions of the conventional expansion valve shown in FIG. 21.

Figure 21:
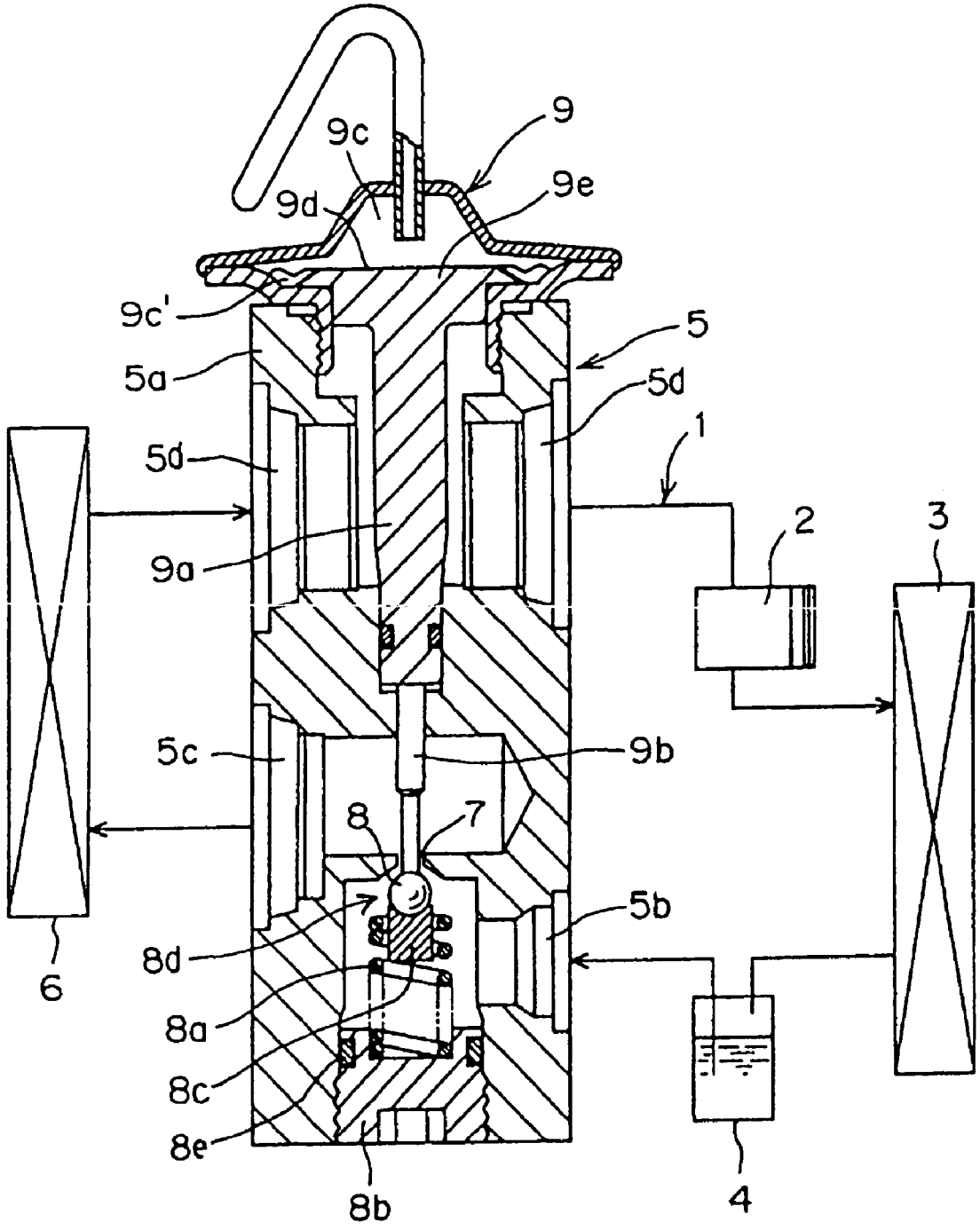
FIG. 21 is a sectional view of a conventional expansion valve in a refrigerating cycle.

The expansion valve of Embodiment 1 is characterized in that constraint means 10 is added to the valve plug 8 of the conventional expansion valve 5 shown in FIG. 21, so that this element will be mainly described in the following. In the expansion valve 5 of Embodiment 1, its valve plug 8 is driven by a temperature sensing drive unit 9 to adjust the flow rate of a refrigerant that flows into an evaporator 6. The drive of the low-pressure refrigerant that is delivered from the evaporator 6. The constraint means 10 that applies a force of constraint to the valve plug 8 is located close to the valve plug 8. The constraint means 10 solves the problem of operational instability of the valve plug 8 that is attributable to fluctuation of pressure of a high-pressure refrigerant.

A valve body 5*a* is provided with an orifice 7 that internally connects a high-pressure passage 5*b* in the expansion valve 5, through which the refrigerant flows in, and a low-pressure passage 5*c* through which refrigerant flows out. The valve plug 8 adjusts the rate of flow of the refrigerant in the orifice 7.

Means for the adjustment includes an operating rod 9*b* that acts in the direction to open the valve plug 8 and the temperature sensing drive unit 9 that drives the rod 9*b*. On the upper-stream side of the high-pressure passage 5*b* with respect to the orifice 7, the constraint means 10 that constrains the valve plug 8 is located in a valve chest 8*d*. The constraint means 10 is attached to the valve body 5*a* and laterally constrains the valve plug 8 by means of its elasticity.

As shown in FIGS. 1 and 3, the valve plug 8 is a ball that is supported by means of a support member 8*c*. The constraint means 10 is a support ring that elastically supports the valve plug 8 and/or the support member 8*c*. FIGS. 1 and 3 show a case in which the support ring 10 elastically constrains the valve plug 8 only.

As shown in FIGS. 2 and 3, the support ring 10 is formed of highly elastic steel, such as stainless steel. It includes a circular annular portion 11 capable of elastic deformation and curved vibration-proof plate springs 12, four in number, for example, which are cut out of the annular portion 11. The vibration-proof springs 12 are curved structures of which the respective distal ends are convexed toward the center of the annular portion 11. The four springs 12 elastically support the periphery of the spherical valve plug 8. In order to enable the support ring 10 to be reduced in diameter so that it can be set in the valve chest 8*d* of the valve body 5*a*, a slit 13 is formed in a part of the annular portion 11.

When the annular portion 11 is set in the valve body 5*a*, according to the support ring 10 constructed in this manner, the valve plug 8 is surrounded and supported by the vibration-proof springs 12 in four positions, and the ring 10 serves as constraint means for the valve plug 8. Even if the refrigerant pressure fluctuates in a refrigerating cycle, therefore, the action of the valve plug 8 can be stabilized. Thus, the flow rate of the refrigerant can be controlled accurately, and production of noise that is attributable to vibration of the valve plug 8 can be prevented.

Embodiment 2

FIG. 4 shows a support ring 10*a* according to Embodiment 2. The support ring 10*a* comprises a circular annular portion 11*a* and vibration-proof plate springs 12*a*, which are arranged on one side of the annular portion 11*a*. In order to enable the support ring 10*a*, like the support ring 10 of Embodiment 1, to be reduced in diameter so that it can be set in the valve chest 8*d* of the valve body 5*a*, a slit 13*a* is formed in a part of the annular portion 11*a*.

The vibration-proof springs 12*a* of the support ring 10*a* of Embodiment 2 are curved plates of which the respective distal ends are convexed toward the center of the annular portion 11*a* and the respective side faces support the periphery of the valve plug 8. In Embodiment 2, as in Embodiment 1, the vibration-proof springs 12*a* are formed by being cut out of the annular portion 11*a*.

If the refrigerant pressure fluctuates in the refrigerating cycle in Embodiment 2 arranged in this manner, as in Embodiment 1 shown in FIGS. 2 and 3, the flow rate of the refrigerant can be controlled accurately, and production of noise that is attributable to vibration of the valve plug 8 can be prevented.

Embodiment 3

Figure 5:
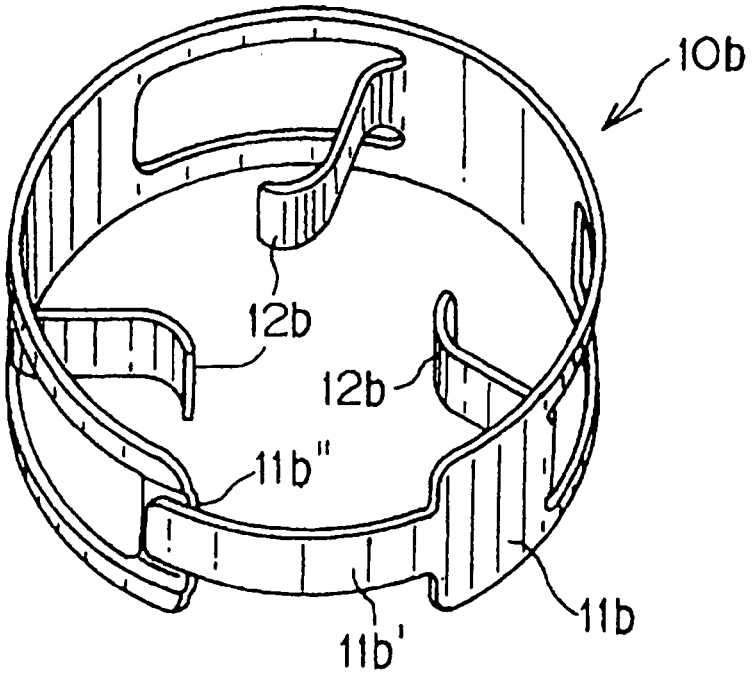
FIG. 5 is a perspective view of a support ring used in an expansion valve according to Embodiment 3 of the invention.
Figure 6:
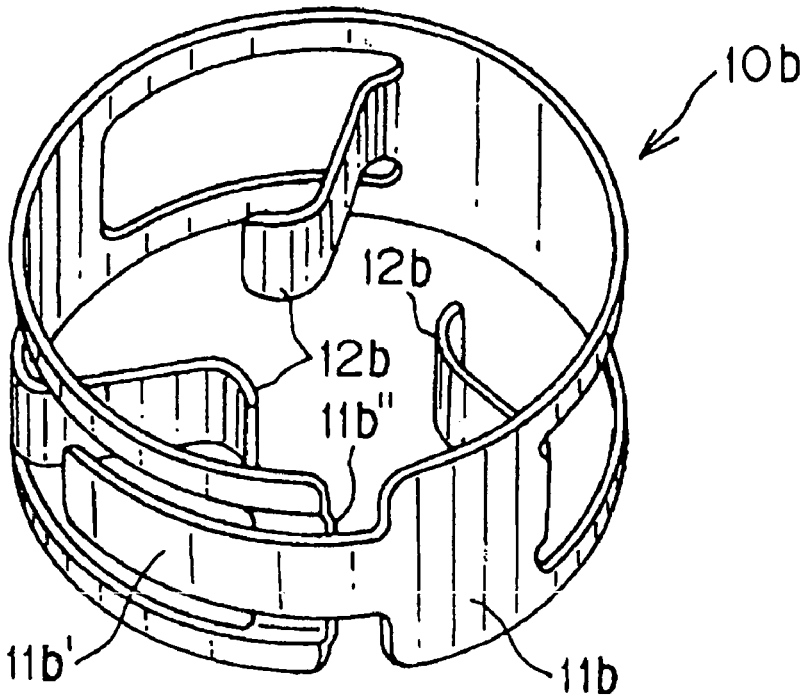
FIG. 6 is a perspective view showing the support ring of FIG. 5 in a set state.
Figure 7:
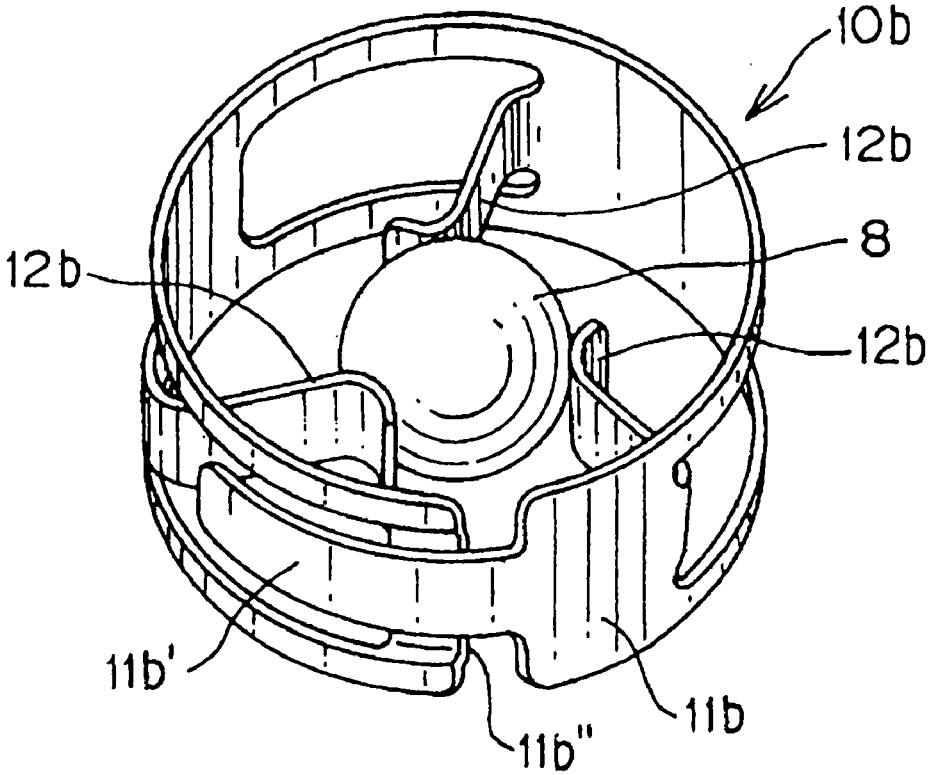
FIG. 7 is a perspective view showing the way the support ring of FIG. 5 supports a valve plug.

FIGS. 5 to 7 show a support ring 10*b* according to Embodiment 3. FIG. 5 is a perspective view of the support ring, FIG. 6 is a perspective view showing the support ring in a set state, and FIG. 7 is a perspective view showing the way the support ring supports a valve plug.

In Embodiment 3, an intersecting portion, instead of the slits 13 and 13*a* of Embodiments 1 and 2, is formed on the end portions of a plate that constitutes an annular portion 11*b*. As shown in FIG. 5, the intersecting portion is formed of a narrow tongue 11*b*' having a given length and a tongue receiving recess 11*b*", which guides and supports the tongue 11*b*'. The tongue 11*b*' extends from one end portion of the annular portion 11*b*, sharing the curvature with the annular portion 11*b*. The tongue receiving recess 11*b*" is formed in the other end of the annular portion 11*b*.

Near the other end portion of the annular portion 11*b*, the tongue receiving recess 11*b*" is formed between its upper and lower edge portions. The annular portion 11*b* is formed so that the tongue 11*b*', which overlaps the tongue receiving recess 11*b*" in the valve body 5*a*, prevents formation of any gap between the annular portion 11*b* and the inner wall of the valve body 5*a*. Preferably, therefore, the depth of the tongue receiving recess 11*b*" should be equal to or greater than the thickness of the tongue 11*b*'.

The support ring 10*b* according to Embodiment 3, like the ones according to Embodiments 1 and 2, is formed of highly elastic steel, such as stainless steel. It includes a circular annular portion 11*b* and curved vibration-proof plate springs 12*b*; three in number, as shown in FIG. 5; for example, which are cut out of the annular portion 11*b*. The vibration-proof springs 12*b* are curved structures of which the respective distal ends are convexed toward the center of the annular portion 11*b*. The three springs 12*b* elastically support the periphery of the valve plug 8, as shown in FIG. 7.

When the annular portion 11*b* is set in the valve body 5*a*, according to the support ring 10*b* constructed in this manner, the valve plug 8 is surrounded and supported by the vibration-proof springs 12*b* in three positions, a necessary minimum, and the ring 10*b* serves as constraint means for the valve plug 8. Even if the refrigerant pressure fluctuates in the refrigerating cycle, therefore, the action of the valve plug 8 can be stabilized. Thus, the flow rate of the refrigerant can be controlled accurately, and production of noise that is attributable to vibration of the valve plug 8 can be prevented.

In Embodiment 3, the annular portion 11*b* has no slit. If a lot of support rings 10*b* are packaged together or in an automatic assembly process for expansion valves, the support rings can be smoothly handled without getting intertwined with one another.

Embodiment 4

Figure 8:
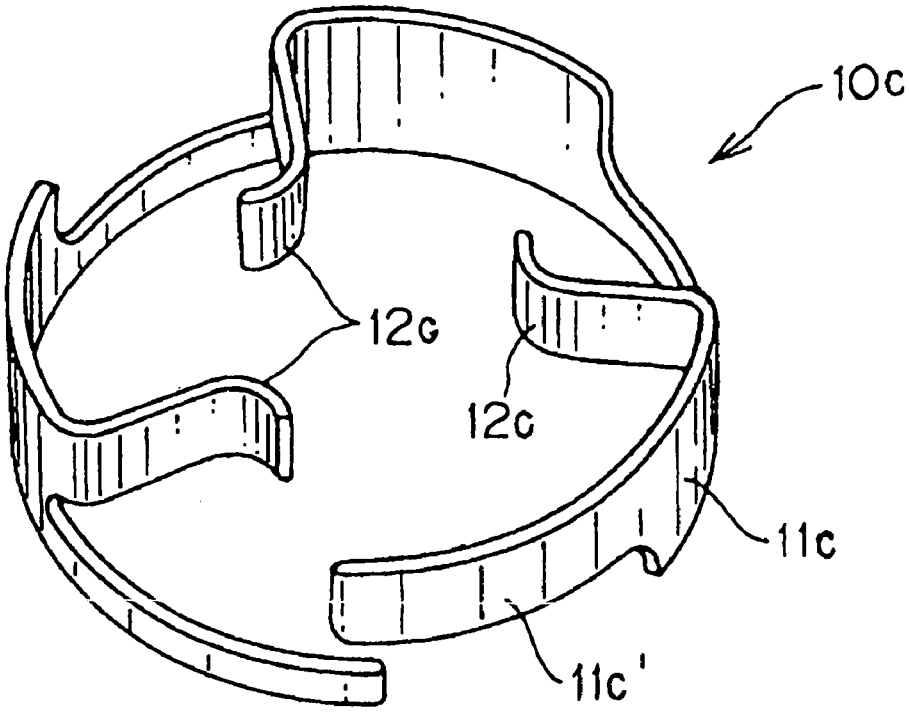
FIG. 8 is a perspective view of a support ring used in an expansion valve according to Embodiment 4 of the invention.
Figure 9:
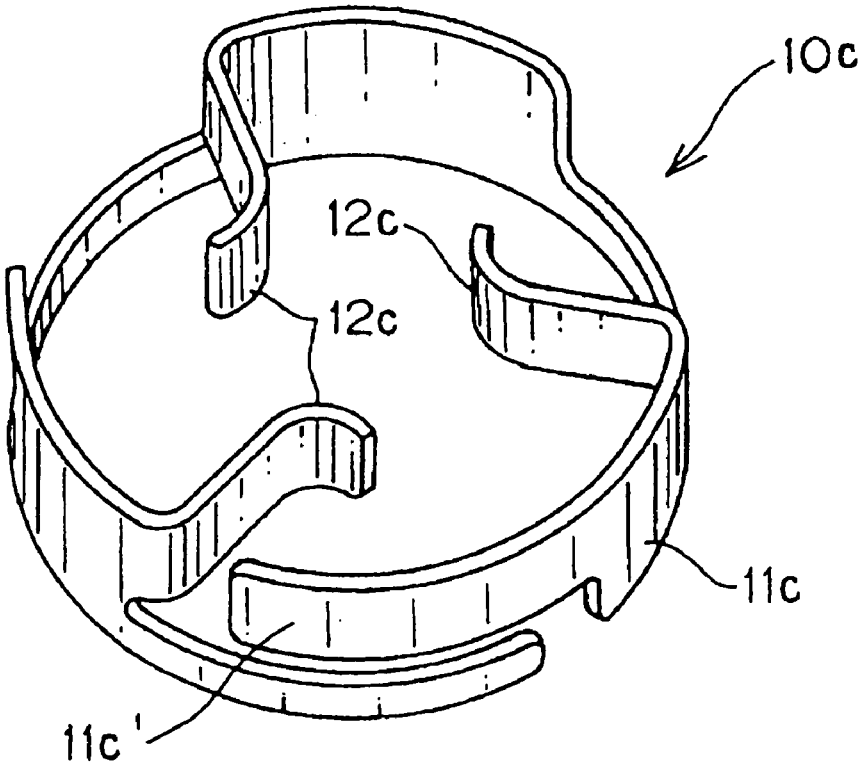
FIG. 9 is a perspective view showing the support ring of FIG. 8 in a set state.

Embodiment 4 will now be described with reference to FIGS. 8 to 10. FIG. 8 is a perspective view of a support ring 10*c* according to Embodiment 4, FIG. 9 is a perspective view showing the support ring in a set state, and FIG. 10 is a perspective view showing the way the support ring supports a valve plug.

As shown in FIG. 8, the support ring 10*c* of Embodiment 4 comprises a circular annular portion 11*c* and three vibration-proof plate springs 12*c*, which are arranged on one side of the annular portion 11*c*. In Embodiment 4, as in Embodiment 3, an intersecting portion is formed on the end portions of a plate that constitutes the annular portion 11*c*. The intersecting portion is formed of a narrow tongue 11*c*', which extends from one end portion the annular portion 11*c*, and a narrowed portion on the other end, which overlaps the tongue 11*c*' within the same plane. The tongue 11*c*' shares the curvature with the annular portion 11*c*. The vibration-proof springs 12*c* share the shape, material, and number with the springs 12*b* of Embodiment 3.

Figure 10:
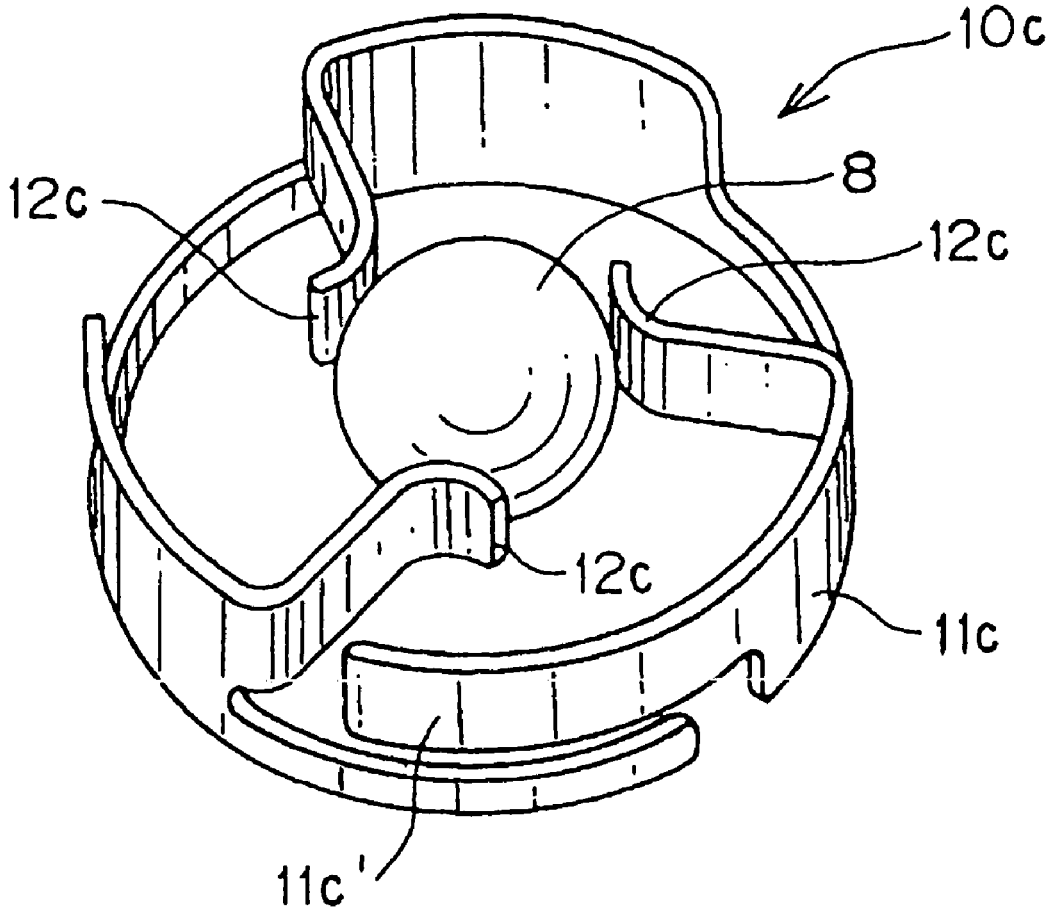
FIG. 10 is a perspective view showing the way the support ring of FIG. 8 supports a valve plug.

When the annular portion 11*c* is set in the valve body 5*a*, according to the support ring 10*c* constructed in this manner, the valve plug 8 is surrounded and supported by the vibration-proof springs 12*c* in three positions, as shown in FIG. 10, and the ring 10*c* serves as constraint means for the valve plug 8. Even if the refrigerant pressure fluctuates in the refrigerating cycle, therefore, the action of the valve plug 8 can be stabilized. Thus, the flow rate of the refrigerant can be controlled accurately, and production of noise that is attributable to vibration of the valve plug 8 can be prevented.

In the embodiments described above, the vibration-proof springs 12, 12*a*, 12*b* and 12*c* that constitute the support rings 10, 10*a*, 10*b* and 10*c*, respectively, have uniform width throughout the length. Naturally, however, they may be formed having any other shape. For example, each spring may be in the shape of a triangle that has a vertex on its distal end portion such that its elasticity is adjustable. It is to be understood, moreover, that the intersecting portions of Embodiments 3 and 4 may be varied in shape.

Furthermore, the slits 13 and 13*a* of Embodiments 1 and 2 are formed extending across the support rings 10 and 10*a*, respectively, at right angles to their circumferential direction. Alternatively, however, they may be formed aslant the circumferential direction of support rings 10 and 10*a*.

Embodiment 5

Figure 11:
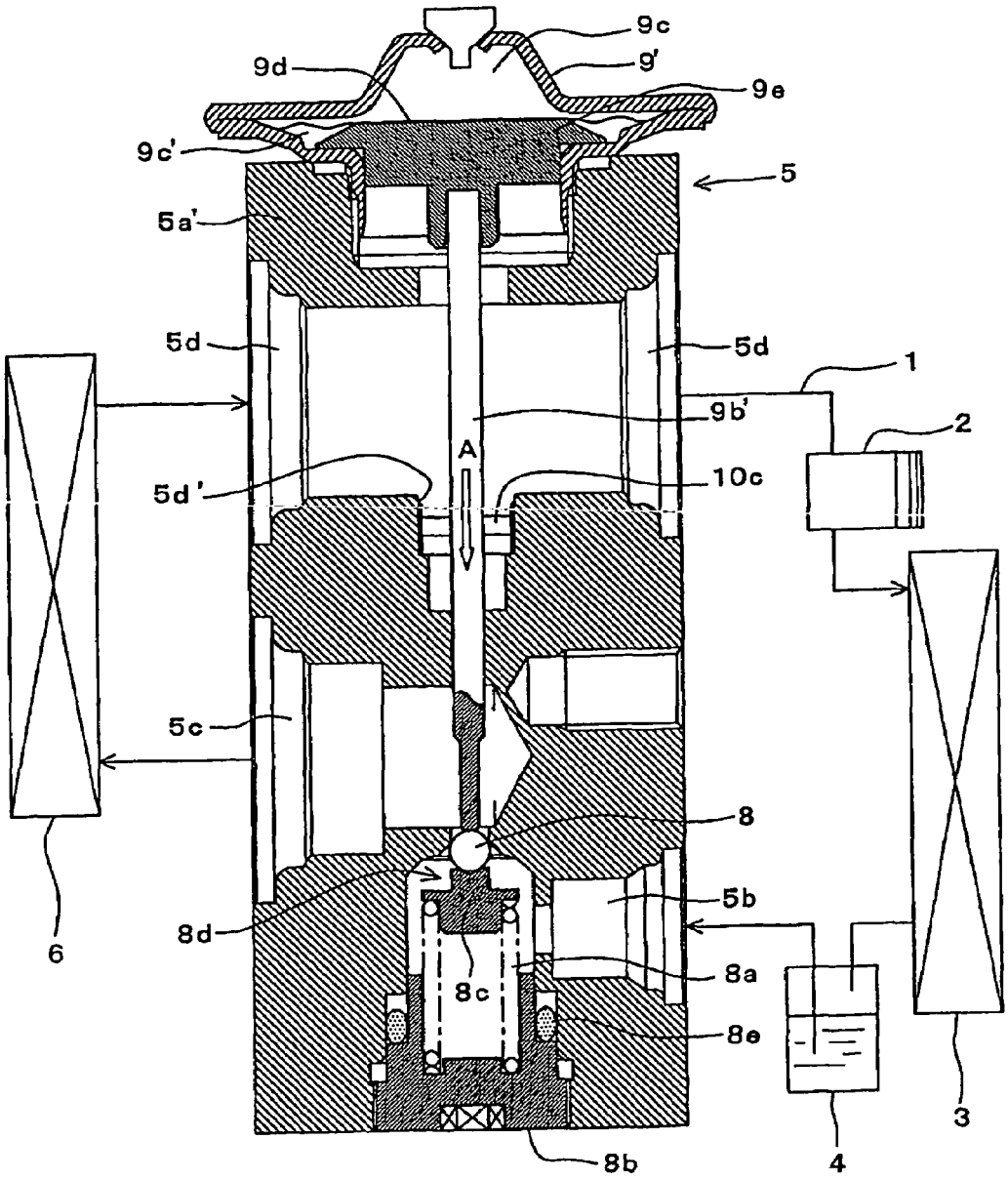
FIG. 11 is a longitudinal sectional view of an expansion valve according to Embodiment 5 of the invention.
Figure 12:
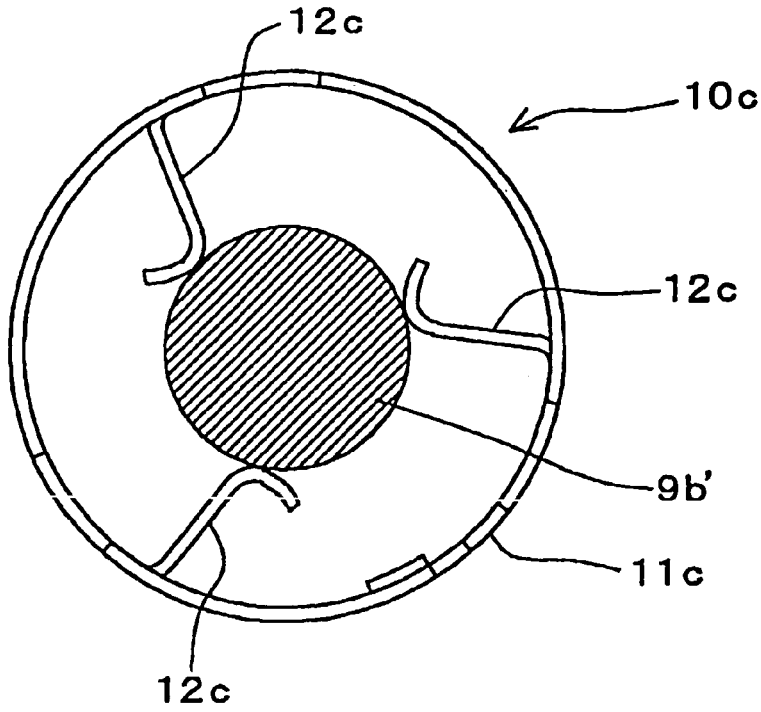
FIG. 12 is a view taken in the direction of arrow A of FIG. 11.

Embodiment 5 will now be described with reference to FIGS. 11 and 12. FIG. 11 is a longitudinal sectional view showing a principal part of an expansion valve according to Embodiment 5, and FIG. 12 is a view taken in the direction or arrow A of FIG. 11. In FIG. 11, like numerals are used to designate like components of the expansion valve shown in FIG. 21. In FIG. 12, moreover, like numerals are used to designate like portions of the vibration-proof springs shown in FIG. 8.

In Embodiment 5, as shown in FIG. 11, the support ring 10*c* shown in FIGS. 8 and 9 is used as constraint means for supporting an operating rod 9*b*'.

The upper part of the operating rod 9*b*' is coupled integrally to a disc portion 9*e* that constitutes a temperature sensing drive unit 9'. The interior of the drive unit 9' is divided into two parts, an upper airtight chamber 9*c* and a lower airtight chamber 9*c*', by a diaphragm 9*d*. The disc portion 9*e* on the upper end of the operating rod 9*b*' is in contact with the diaphragm 9*d*. Further, the support ring 10*c* is fitted in a bore portion 5*d*' that communicates with a low-pressure refrigerant passage 5*d* in a valve body 5*a*'.

Thus, the annular portion 11*c* of the support ring 10*c* is elastically attached to the inner wall of the bore portion 5*d*', and the three vibration-proof springs 12*c* support the side face of the operating rod 9*b*'.

At the bottom of the valve body 5*a*', moreover, a compression coil spring 8*a* that urges the support member 8*c* to press the valve plug 8 in the valve closing direction is located in the valve chest 8*d*. The valve chest 8*d* is defined by an adjusting screw 8*b* that mates with the valve body 5*a*', and is kept airtight by means of an O-ring 8*e*. The lower end of the operating rod 9*b*' abuts against the valve plug 8. As the rod 9*b*' slides downward, it moves the valve plug 8 in the valve opening direction.

The operating rod 9*b*' that constitutes the temperature sensing drive unit 9' transmits the temperature in the low-pressure refrigerant passage 5*d* to the upper airtight chamber 9*c*. The pressure in the chamber 9*c* changes depending on the transmitted temperature. If the temperature is high, for example, the pressure in the upper airtight chamber 9*c* rises, and the diaphragm 9*d* urges the disc portion 9*e* to depress the operating rod 9*b*'. Thereupon, the valve plug 8 moves in the valve opening direction, so that the volume of passage of the refrigerant through the orifice 7 increases, and the temperature of the evaporator 6 is lowered.

If the temperature in the low-pressure refrigerant passage 5*d* is low, on the other hand, the pressure in the upper airtight chamber 9*c* lowers, so that the force of the diaphragm 9*d* to depress the disc portion 9*e* lessens. Thereupon, the compression coil spring 8*a*, which presses the valve plug 8 in the valve closing direction, urges the valve plug 8 to move in the valve closing direction. Thus, the volume of passage of the refrigerant through the orifice 7 is reduced, and the temperature of the evaporator 6 is raised.

When the support ring 10*c* is set in the valve body 5*a*' as this is done, the operating rod 9*b*', which is elastically in contact with the valve plug 8, is surrounded and supported by the vibration-proof springs 12*c* in three positions, and the ring 10*c* serves as constraint means that acts on the valve plug 8 through the operating rod 9*b*'. Even if the refrigerant pressure fluctuates in the refrigerating cycle, therefore, the action of the valve plug 8 can be stabilized. Thus, the flow rate of the refrigerant can be controlled accurately, and production of noise that is attributable to vibration of the valve plug 8 can be prevented.

According to Embodiment 5, in particular, the support ring 10*c* is located on that part of the operating rod 9*b*' which is distant from the refrigerant passage, so that it constitutes no resistance against the refrigerant flow. It can also eliminate the possibility of its producing vibration or noise attributable to the refrigerant flow.

It is to be understood that the support ring 10*c* according to Embodiment 5 may be used in combination with both the operating rod 9*b*' and the valve plug 8.

Embodiment 6

Figure 13:
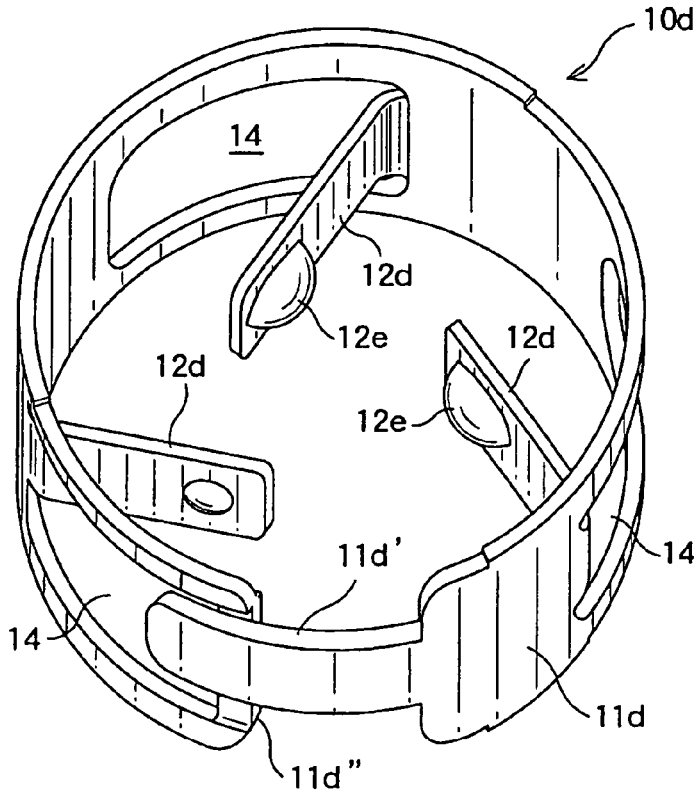
FIG. 13 is a perspective view of a support ring used in an expansion valve according to Embodiment 6 of the invention.
Figure 14:
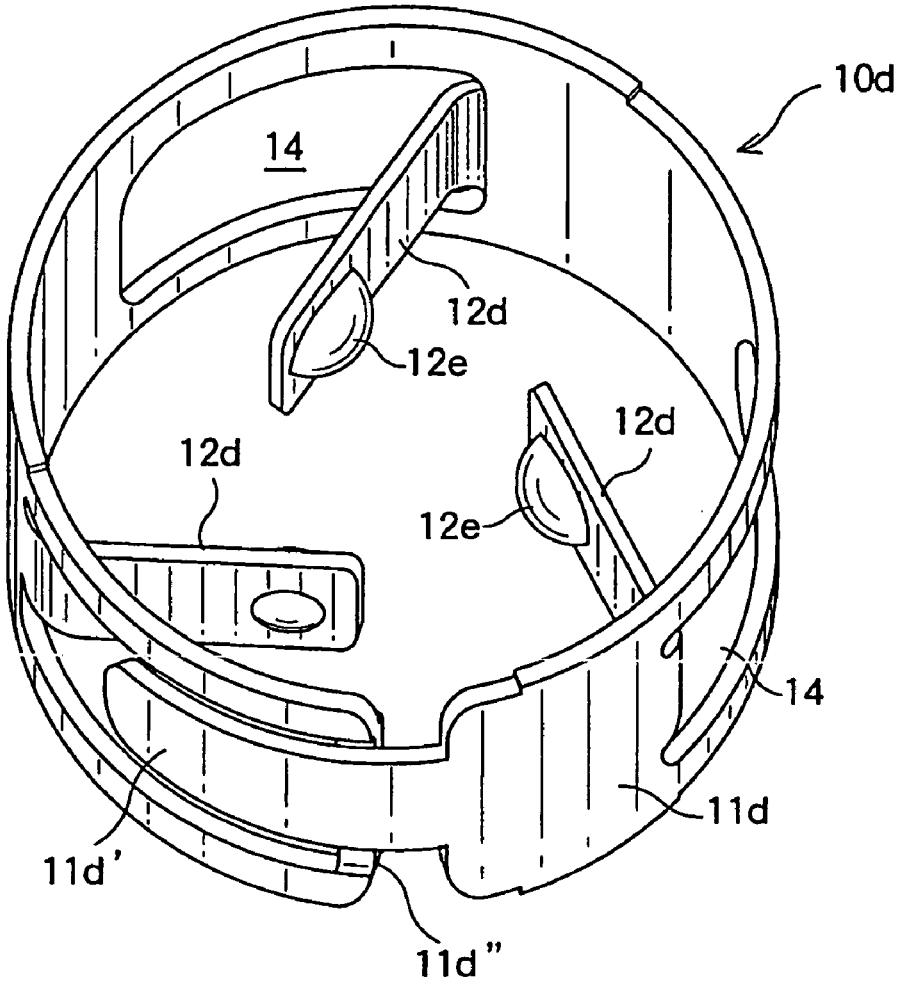
FIG. 14 is a perspective view showing the support ring of FIG. 13 in a set state.
Figure 15A:
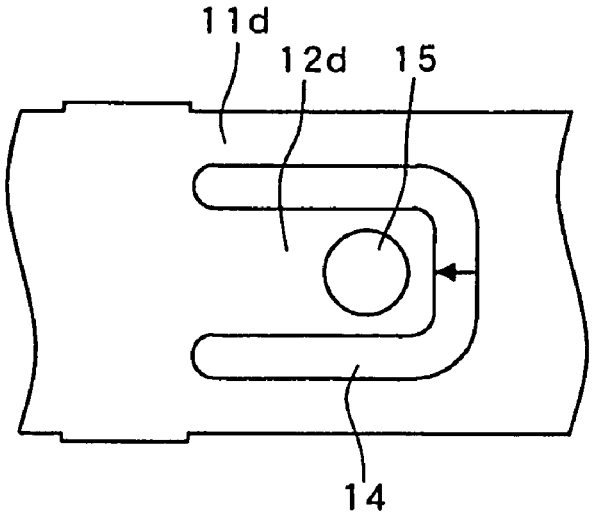
FIG. 15A is a partial view illustrating the support ring of FIG. 13.
Figure 15B:
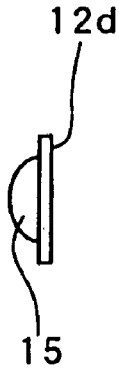
FIG. 15B is a side view of a principal part taken in the direction of the arrow in FIG. 15A.
Figure 16:
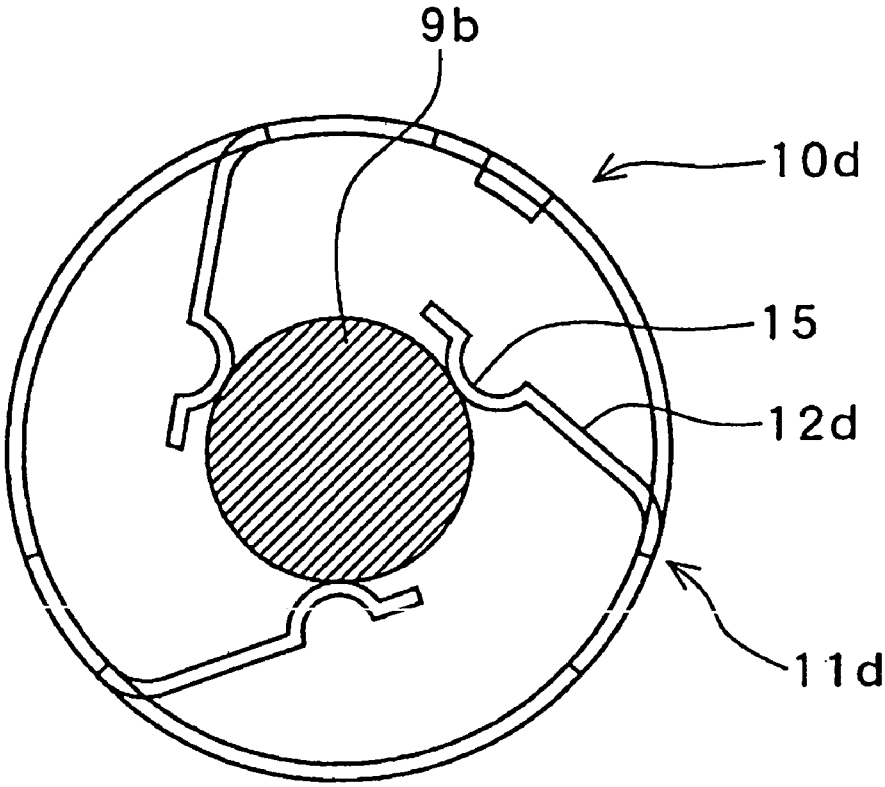
FIG. 16 is a plan view showing the support ring of FIG. 13 in the set state.

Embodiment 6 will now be described with reference to FIGS. 13 and 16. FIG. 13 is a perspective view of a support ring 10*d* according to Embodiment 6. FIG. 14 is a perspective view showing a configuration such that the support ring of FIG. 13 is located in the bore portion 5*d*' of FIG. 11. FIG. 15A is a partial view illustrating the support ring of FIG. 13. FIG. 15B is a side view of a principal part taken in the direction of the arrow in FIG. 15A. FIG. 16 is a plan view showing the way the support ring of FIG. 13 is fitted on the operating rod 9*b*'.

In Embodiment 6, which is a modification of Embodiment 5, the support ring 10*d* shown in FIGS. 13 to 16 is used as constraint means for supporting the operating rod 9*b*', as in Embodiment 5.

As in Embodiment 5, the upper part of the operating rod 9*b*' is coupled integrally to the disc portion 9*e* that constitutes the temperature sensing drive unit 9'. The interior of the drive unit 9' is divided into two parts, the upper airtight chamber 9*c* and the lower airtight chamber 9*c*', by the diaphragm 9*d*, as shown in FIG. 11. The disc portion 9*e* on the upper end of the operating rod 9*b*' is in contact with the diaphragm 9*d*.

The support ring 10*d* is fitted in the bore portion 5*d*' that communicates with the low-pressure refrigerant passage 5*d* in the valve body 5*a*' shown in FIG. 11. An annular portion 11*d* of the support ring 10*d* is elastically attached to the inner wall of the bore portion 5*d*'. In the support ring 10*d* of Embodiment 6, as shown in FIGS. 14, 15A and 15B, a hemispherical portion 15 is formed on the distal end portion of each of three vibration-proof plate springs 12*d* that are formed on the inner surface of the annular portion 11*d*. The hemispherical portion 15 is brought into pointed contact with the side face of the operating rod 9*b*', thereby engaging and supporting the rod 9*b*'. As in the case of Embodiment 3, moreover, a narrow tongue 11*d*' is formed on one end portion of the annular portion 11*d*, and a tongue receiving recess 11*d*" is formed in the other end portion. As shown in FIGS. 13 to 15, furthermore, the annular portion 11*d*, like the ones according to Embodiments 1 and 3, is formed having hollow portions 14 that are arranged in its circumferential direction.

At the bottom of the valve body 5*a*', the compression coil spring 8*a* that urges the support member 8*c* to press the valve plug 8 in the valve closing direction is located in the valve chest 8*d*. The valve chest 8*d* is defined by the adjusting screw 8*b* that mates with the valve body 5*a*', and is kept airtight by means of the O-ring 8*e*. The lower end of the operating rod 9*b*' abuts against the valve plug 8. As the rod 9*b*' slides downward, it moves the valve plug 8 in the valve opening direction.

The operating rod 9*b*' that constitutes the temperature sensing drive unit 9' transmits the temperature in the low-pressure refrigerant passage 5*d* to the upper airtight chamber 9*c*. The pressure in the chamber 9*c* changes depending on the transmitted temperature. If the temperature is high, for example, the pressure in the upper airtight chamber 9*c* rises, and the diaphragm 9*d* urges the disc portion 9*e* to depress the operating rod 9*b*'. Thereupon, the valve plug 8 moves in the valve opening direction, so that the volume of passage of the refrigerant through the orifice 7 increases, and the temperature of the evaporator 6 is lowered.

If the temperature in the low-pressure refrigerant passage 5*d* is low, on the other hand, the pressure in the upper airtight chamber 9*c* lowers, so that the force of the diaphragm 9*d* to depress the disc portion 9*e* lessens. Thereupon, the compression coil spring 8*a*, which presses the valve plug 8 in the valve closing direction, urges the valve plug 8 to move in the valve closing direction. Thus, the volume of passage of the refrigerant through the orifice 7 is reduced, and the temperature of the evaporator 6 is raised.

When the support ring 10*d* is set in the valve body 5*a*' as this is done, the operating rod 9*b*', which is elastically in contact with the valve plug 8, is supported by the hemispherical portions 15 on the three vibration-proof springs 12*d* that pointedly touch the side face of the rod 9*b*' in three positions. Accordingly, the ring 10*d* serves as constraint means that acts on the valve plug 8 through the operating rod 9*b*'. Even if the refrigerant pressure fluctuates in the refrigerating cycle, therefore, the action of the valve plug 8 can be stabilized. Thus, the flow rate of the refrigerant can be controlled accurately, and production of noise that is attributable to vibration of the valve plug 8 can be prevented.

According to Embodiment 6, as in Embodiment 5, in particular, the support ring 10*d* is located on that part of the operating rod 9*b*' which is distant from the refrigerant passage, so that it constitutes no resistance against the refrigerant flow. It can also eliminate the possibility of its producing vibration or noise attributable to the refrigerant flow. Since the vibration-proof springs 12*d* of the support ring 10*d* are in pointed contact with the operating rod 9*b*', moreover, the rod 9*b*' can be smoothly supported if it is somewhat inclined.

Embodiment 7

Figure 17A:
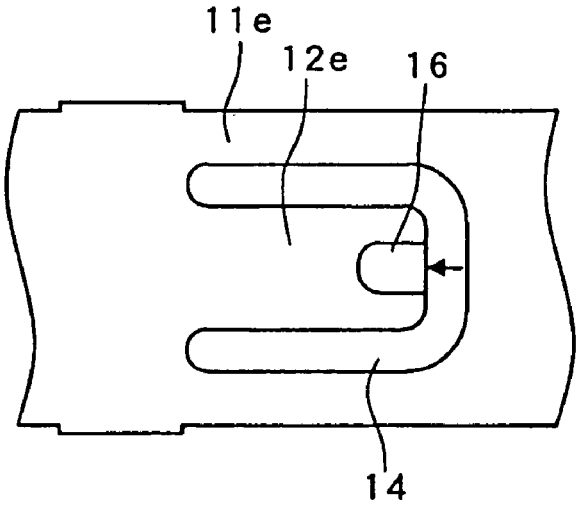
FIG. 17A is a partial view illustrating a support ring used in an expansion valve according to Embodiment 7 of the invention.
Figure 17B:
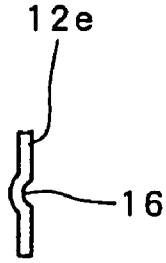
FIG. 17B is a side view of a principal part taken in the direction of the arrow in FIG. 17A.
Figure 18:
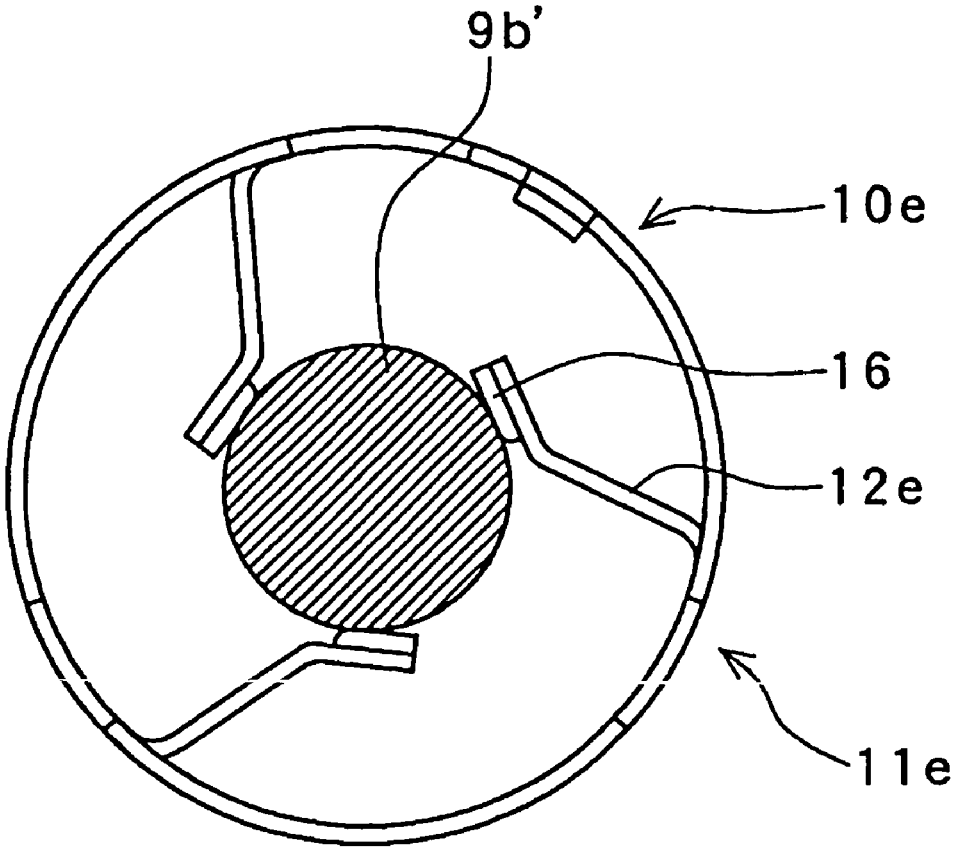
FIG. 18 is a plan view showing the support ring of FIGS. 17A and 17B in a set state.

Embodiment 7 will now be described with reference to FIGS. 17A, 17B and 18. FIG. 17A is a partial view of a support ring 10*e* according to Embodiment 7. FIG. 17B is a side view of a principal part taken in the direction of the arrow in FIG. 17A. FIG. 18 is a plan view showing the way the support ring of FIG. 17 is set in place.

In Embodiment 7, which is a modification of Embodiment 6, the support ring 10*e* shown in FIGS. 17 and 18 is used as constraint means for supporting the operating rod 9*b*', as in Embodiment 6. An expansion valve to which Embodiment 7 is applied is constructed in the same manner as the expansion valve of Embodiment 5 shown in FIG. 11 except for the shape of the support ring. Therefore, a description of this valve is omitted.

The support ring 10*e*, like the one according to Embodiment 5, is fitted in the bore portion 5*d*' that communicates with the low-pressure refrigerant passage 5*d* in the valve body 5*a*' shown in FIG. 11. As shown in FIGS. 17A, 17B and 18, the support ring 10*e* has three vibration-proof springs 12*e* that are formed inside and integrally with an annular portion 11*e*. The respective distal end portions of the springs 12*e* are bent in the same direction. A curved ridge portion 16 having a cylindrical peripheral surface is formed on the distal end portion of each spring 12*e*. The ridge portion 16 is brought into pointed contact with the peripheral surface of the operating rod 9*b*', thereby supporting the rod 9*b*'.

Constructed in this manner, the support ring 10*e* serves as constraint means that acts on the valve plug 8 through the operating rod 9*b*'. Even if the refrigerant pressure fluctuates in the refrigerating cycle, therefore, the action of the valve plug 8 can be stabilized. Thus, the flow rate of the refrigerant can be controlled accurately, and production of noise that is attributable to vibration of the valve plug 8 can be prevented.

According to Embodiment 7, as in Embodiments 5 and 6, in particular, the support ring 10*e* is located on that part of the operating rod 9*b*' which is distant from the refrigerant passage, so that it constitutes no resistance against the refrigerant flow. It can also eliminate the possibility of its producing vibration or noise attributable to the refrigerant flow. Since the vibration-proof springs 12*e* of the support ring 10*e* are in pointed contact with the operating rod 9*b*', moreover, the rod 9*b*' can be smoothly supported if it is somewhat inclined or if the springs 12*e* are elastically deformed.

Embodiment 8

Figure 19A:
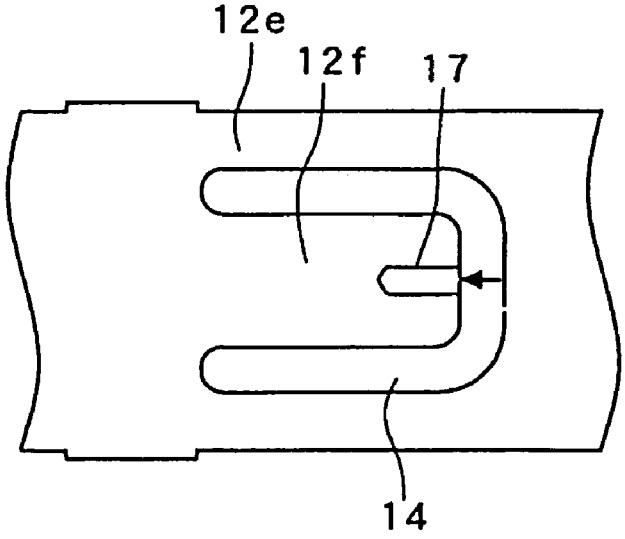
FIG. 19A is a partial view illustrating a support ring according to Embodiment 8 of the invention.
Figure 19B:
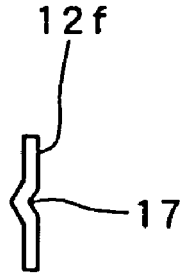
FIG. 19B is a side view of a principal part taken in the direction of the arrow in FIG. 19A.
Figure 20:
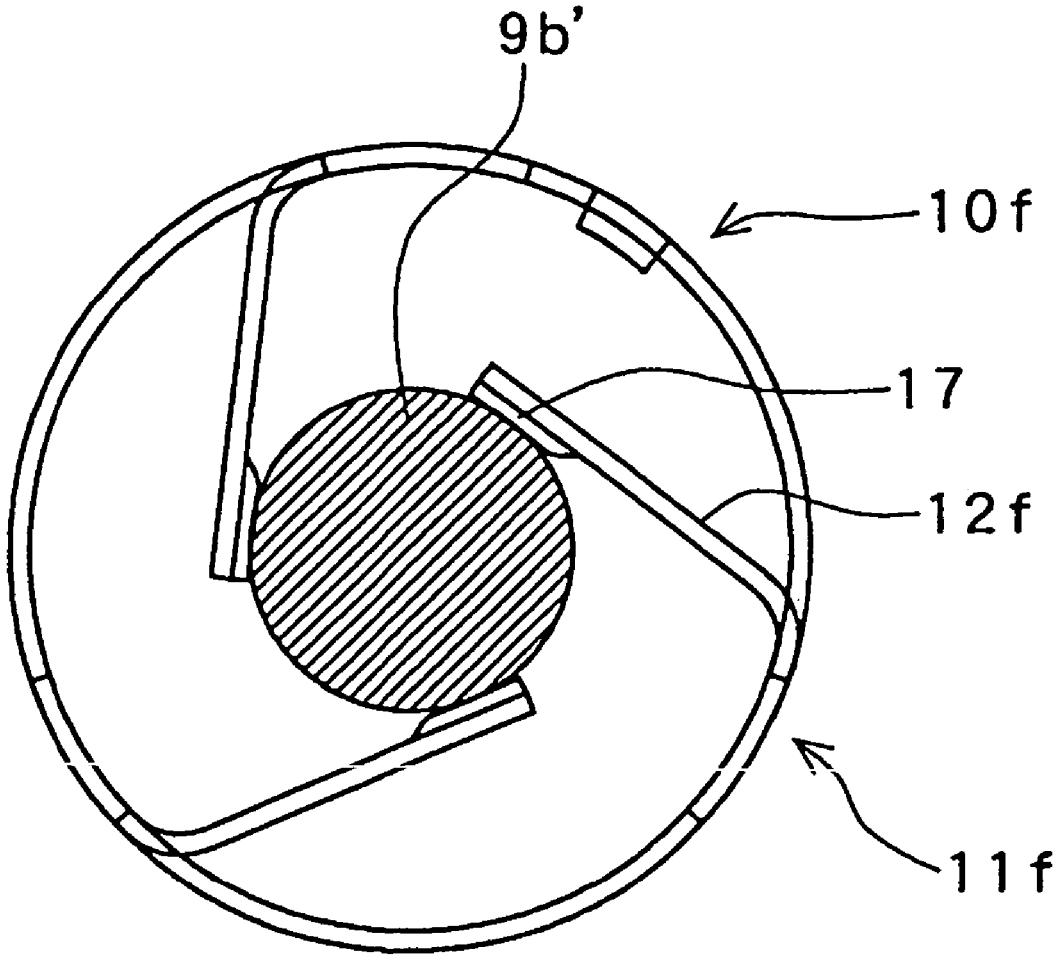
FIG. 20 is a plan view showing the support ring of FIGS. 19A and 19B in a set state.

Embodiment 8 will now be described with reference to FIGS. 19A, 19B and 20. FIG. 19A is a partial view of a support ring 10*f* according to Embodiment 8. FIG. 19B is a side view of a principal part taken in the direction of the arrow in FIG. 19A. FIG. 20 is a plan view showing the way the support ring of FIG. 19 is set in place.

In Embodiment 8, which is a modification of Embodiment 7, the support ring 10*f* shown in FIGS. 19 and 20 is used as constraint means for supporting the operating rod 9*b*', as in Embodiment 7. An expansion valve to which Embodiment 8 is applied is constructed in the same manner as the expansion valve of Embodiment 5 shown in FIG. 11 except for the shape of the support ring. Therefore, a description of this valve is omitted.

The support ring 10*f*, like the one according to Embodiment 5, is fitted in the bore portion 5*d*' that communicates with the low-pressure refrigerant passage 5*d* in the valve body 5*a*' shown in FIG. 11. As shown in FIGS. 19A, 19B and 20, the support ring 10*f* has three vibration-proof springs 12*f* that are formed inside and integrally with an annular portion 11*f*. The respective proximal end portions of the springs 12*f* are bent in the same direction. A ridge portion 17 is formed on the distal end portion of each spring 12*f*. The ridge portion 17 is brought into pointed contact with the peripheral surface of the operating rod 9*b*', thereby supporting the rod 9*b*'.

Constructed in this manner, the support ring 10*f* serves as constraint means that acts on the valve plug 8 through the operating rod 9*b*'. Even if the refrigerant pressure fluctuates in the refrigerating cycle, therefore, the action of the valve plug 8 can be stabilized. Thus, the flow rate of the refrigerant can be controlled accurately, and production of noise that is attributable to vibration of the valve plug 8 can be prevented.

According to Embodiment 8, as in Embodiments 5 to 7, in particular, the support ring 10*f* is located on that part of the operating rod 9*b*' which is distant from the refrigerant passage, so that it constitutes no resistance against the refrigerant flow. It can also eliminate the possibility of its producing vibration or noise attributable to the refrigerant flow. Since the vibration-proof springs 12*f* of the support ring 10*f* are in pointed contact with the operating rod 9*b*' in a narrow area, moreover, the rod 9*b*' can be smoothly supported if it is somewhat inclined or if the springs 12*f* are elastically deformed.

What is claimed is:

1. An expansion valve, in which a valve plug is driven by means of a temperature sensing unit which operates in accordance with the temperature and pressure of a low-pressure refrigerant delivered from an evaporator and adjusts the flow rate of refrigerant flowing into the evaporator, comprising:

constraint means for applying a force of constraint to the valve plug or an operating rod for opening and closing the valve plug, the constraint means being attached to the valve plug or the operating rod, wherein the valve plug is spherical, and the constraint means is a support ring supporting the valve plug or the operating rod, the support ring is formed of upper and lower circular annular portions and vibration-proof plate springs cut out of the annular portions and each said vibration-proof spring is formed having a portion to be in pointed contact with the operating rod.

2. The expansion valve according to claim 1, wherein the support ring is formed of a circular annular portion capable of elastic deformation and vibration-proof springs, the springs supporting the valve plug or the operating rod.

3. The expansion valve according to claim 2, wherein each said vibration-proof spring is formed of a curved plate and supports the valve plug or the operating rod on a side face thereof.

4. The expansion valve according to claim 1, wherein each said vibration-proof spring is formed of a curved plate and supports the valve plug or the operating rod on a side face thereof.

5. The expansion valve according to claim 1, wherein the portion to be in pointed contact with the operating rod is hemispherical.

6. The expansion valve according to claim 1, wherein the portion to be in pointed contact with the operating rod has a cylindrical outer peripheral surface.

7. The expansion valve according to claim 1, wherein the portion to be in pointed contact with the operating rod is in the form of a ridge.

8. An expansion valve comprising:

a valve body having an orifice internally connecting a high-pressure passage through which a refrigerant flows in and a low-pressure passage through which the refrigerant flows out;

a valve plug for adjusting the flow rate of the refrigerant flowing in the orifice;

an operating rod for opening and closing the valve plug;

a temperature sensing drive unit for driving the operating rod; and constraint means for constraining the valve plug or the operating rod, the constraint means being located on the upper-stream side of the high-pressure passage with respect to the orifice, wherein the valve plug is spherical, and the constraint means is a support ring supporting the valve plug or the operating rod, the support ring is formed of upper and lower circular annular portions and vibration-proof plate springs cut out of the annular portions and each said vibration-proof spring is formed having a portion to be in pointed contact with the operating rod.

9. The expansion valve according to claim 8, wherein the portion to be in pointed contact with the operating rod is hemispherical.

10. The expansion valve according to claim 8, wherein the portion to be in pointed contact with the operating rod has a cylindrical outer peripheral surface.

11. The expansion valve according to claim 8, wherein the portion to be in pointed contact with the operating rod is in the form of a ridge.

12. An expansion valve, in which a valve plug is driven by means of a temperature sensing unit which operates in accordance with the temperature and pressure of a low-pressure refrigerant delivered from an evaporator and adjusts the flow rate of refrigerant flowing into the evaporator, comprising:

constraint means for applying a force of constraint to the valve plug or an operating rod for opening and closing the valve plug, the constraint means being attached to the valve plug or the operating, wherein the valve plug is spherical, and the constraint means is a support ring supporting the valve plug or the operating rod, the support ring is formed of a circular annular portion and vibration-proof plate springs arranged on one side of the annular portion and each said vibration-proof spring is formed having a portion to be in pointed contact with the operating rod.

13. The expansion valve according to claim 12, wherein each said vibration-proof spring is formed of a curved plate and supports the valve plug or the operating rod on a side face thereof.

14. The expansion valve according to claim 12, wherein the portion to be in pointed contact with the operating rod is hemispherical.

15. The expansion valve according to claim 12, wherein the portion to be in pointed contact with the operating rod has a cylindrical outer peripheral surface.

16. The expansion valve according to claim 12, wherein the portion to be in pointed contact with the operating rod is in the form of a ridge.

17. An expansion valve comprising:

a valve body having an orifice internally connecting a high-pressure passage through which a refrigerant flows in and a low-pressure passage through which the refrigerant flows out;

a valve plug for adjusting the flow rate of the refrigerant flowing in the orifice an operating rod for opening and closing the valve plug;

a temperature sensing drive unit for driving the operating rod; and constraint means for constraining the valve plug or the operating rod, the constraint means being located on the upper-stream side of the high-pressure passage with respect to the orifice, wherein the valve plug is spherical, and the constraint means is a support ring supporting the valve plug or the operating rod, the support ring is formed of a circular annular portion and vibration-proof plate springs arranged on one side of the annular portion and each said vibration-proof spring is formed having a portion to be in pointed contact with the operating rod.

18. The expansion valve according to claim 17, wherein the portion to be in pointed contact with the operating rod is hemispherical.

19. The expansion valve according to claim 17, wherein the portion to be in pointed contact with the operating rod has a cylindrical outer peripheral surface.

20. The expansion valve according to claim 17, wherein the portion to be in pointed contact with the operating rod is in the form of a ridge.

21. The expansion valve according to claim 1 or 8 or 12 or 17, wherein the constraint means is attached to the valve body.

22. The expansion valve according to claim 1 or 8 or 12 or 17, wherein the constraint means applies a force of constraint to the valve plug or the operating rod by means of elasticity.

* * * * *

UNITED STATES PATENT AND TRADEMARK OFFICE

CERTIFICATE OF CORRECTION

PATENT NO. : 7,299,995 B2
APPLICATION NO. : 10/797106
DATED : November 27, 2007
INVENTOR(S) : Daisuke Watari et al.

It is certified that error appears in the above-identified patent and that said Letters Patent is hereby corrected as shown below:

Title Page:
Item (73) should be read as follows:
-- Fujikoki Corporation, Tokyo (JP) --.

Signed and Sealed this

Thirteenth Day of May, 2008

JON W. DUDAS
*Director of the United States Patent and Trademark Office*